United States Patent [19]

Marcus

[11] Patent Number: 4,572,386

[45] Date of Patent: Feb. 25, 1986

[54] CONTAINER WITH ATTACHABLE SPOUT

[76] Inventor: Paul Marcus, 85 Pascack Rd., Pearl River, N.Y. 10965

[21] Appl. No.: 667,621

[22] Filed: Nov. 2, 1984

[51] Int. Cl.[4] ..... B65D 25/48

[52] U.S. Cl. ..... 215/228; 220/85 SP; 206/508

[58] Field of Search ..... 215/228, 307, 33; 220/85 SP, 90.4; 206/508; 222/567

[56] References Cited

U.S. PATENT DOCUMENTS

| | | | |
|---|---|---|---|
| 2,171,302 | 8/1939 | Conner | 220/85 SP |
| 2,743,844 | 5/1956 | Livingstone | 220/85 SP |
| 3,243,068 | 3/1966 | Huston | 206/508 X |
| 3,672,547 | 6/1972 | Kozlowski | 220/85 SP X |

FOREIGN PATENT DOCUMENTS

| | | | |
|---|---|---|---|
| 614827 | 2/1961 | Canada | 220/85 SP |

*Primary Examiner*—Steven M. Pollard

*Attorney, Agent, or Firm*—Kane, Dalsimer, Kane, Sullivan and Kurucz

[57] ABSTRACT

A container has a spout that can be attached to a container neck by a locking ring during use. During storage, the spout may be inverted and inserted into the neck with a plug fitted to the locking ring to form a seal across the neck. The spout may be screwed onto or welded to the container neck and a cap at the top of the spout may be threadably engaged thereto or provided by a cut away portion of the spout that can be inverted and used as a cap. The bottom of the container is provided with a push-up for receiving, a neck or spout of another container for stackability.

3 Claims, 9 Drawing Figures

FIG.1
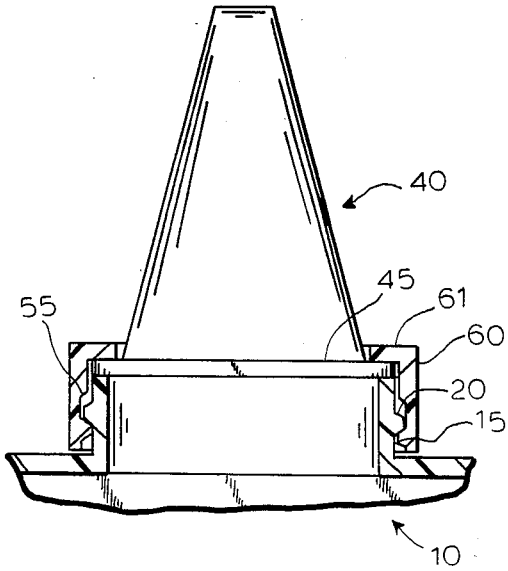
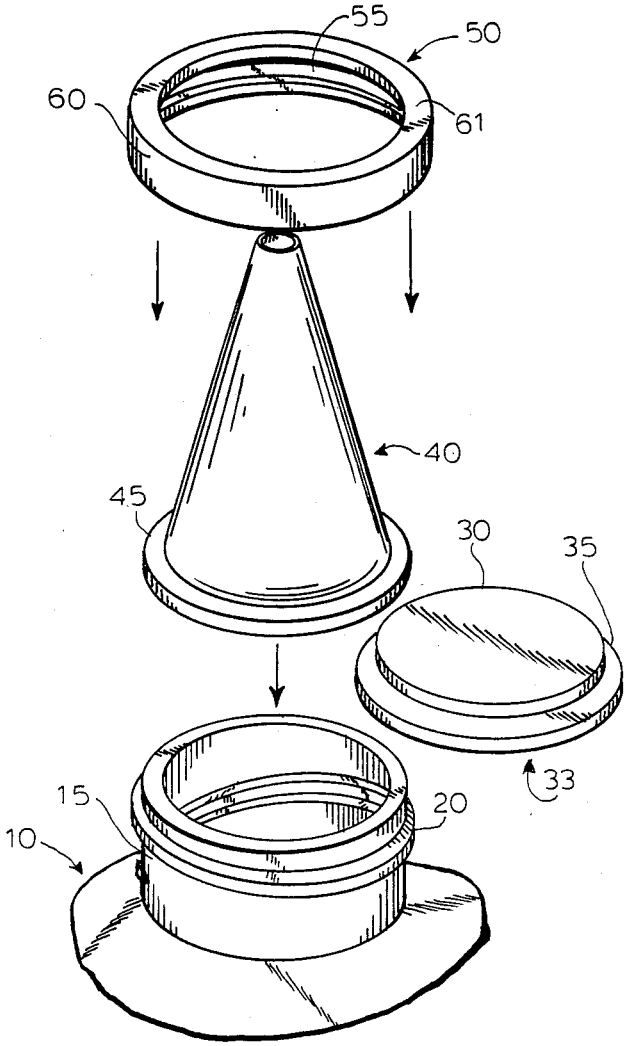
FIG. 3
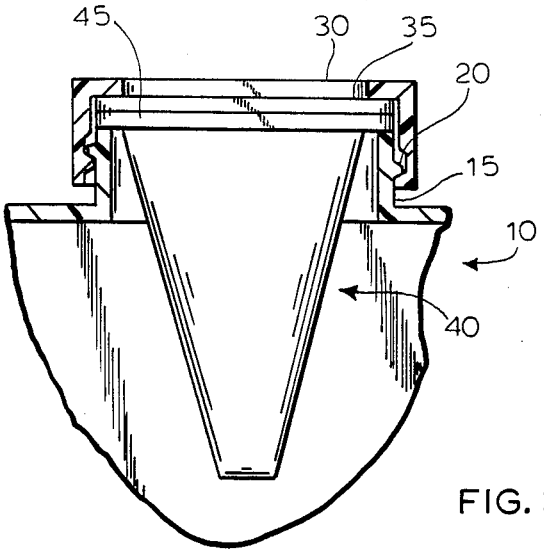
FIG. 2

FIG. 6
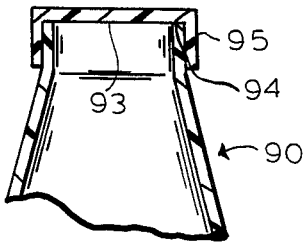
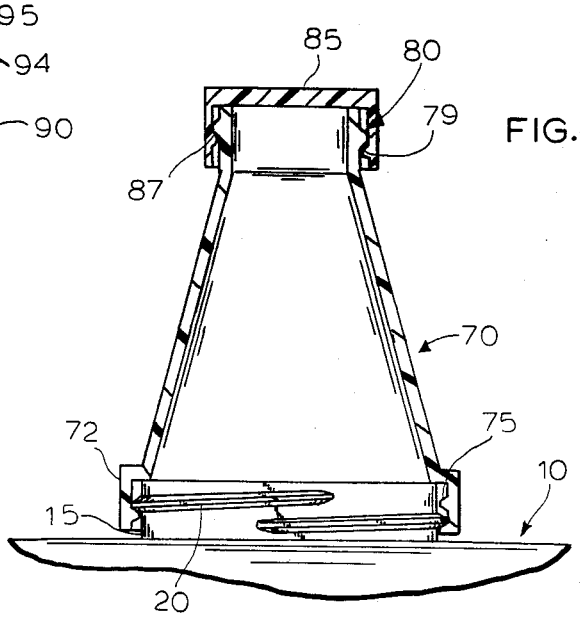
FIG. 4
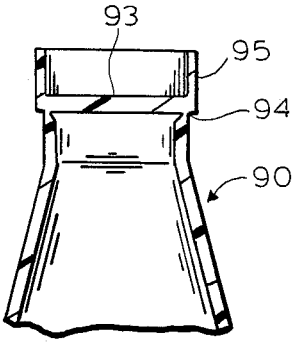
FIG. 5
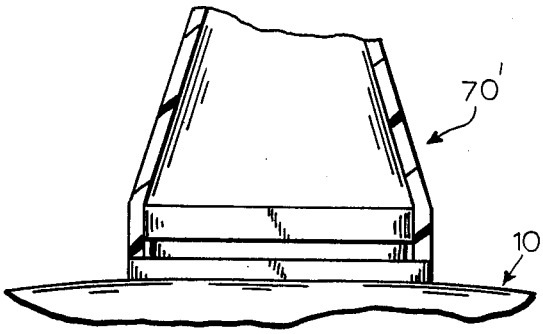
FIG. 7

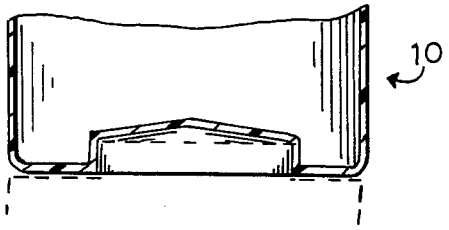
FIG. 8A
FIG. 8B
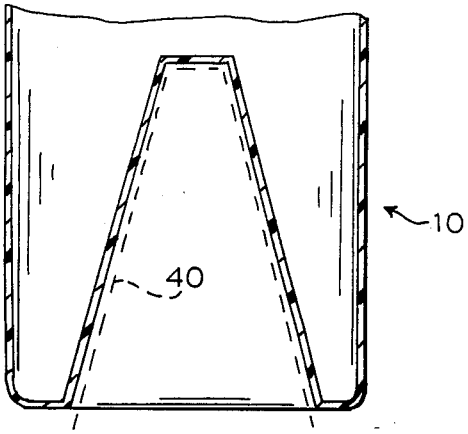

CONTAINER WITH ATTACHABLE SPOUT

The present invention relates to oil containers, and particularly to an oil container having a spout all of which may be made of plastic.

BACKGROUND OF THE INVENTION

Lubricating oils are sold by gasoline service stations, automotive and other retail outlets as well, in containers that are usually cylindrical in shape. The cylindrical body has metallic end portions and a seam joining the top metallic ends with the cylindrical body portion. If the purchaser wishes to administer the oil himself, he will normally require some form of can opener and a funnel of some type. The process of opening the container and pouring the oil through the funnel can be particularly messy and an opener and funnel are not always readily available.

SUMMARY OF THE INVENTION

A principal purpose of the present invention is to provide a container to refineries or other bulk filling stations for filling with oil, automotive additives or chemicals and then for distribution to service stations and the like.

It is an object of the present invention to provide an improved container for oil, automotive additives or chemicals that is supplied or comes with its own spout.

Another object is to provide a container that requires minimum of auxiliary apparatus for use and emptying.

A further object is to provide a container that makes the administration of oil, automotive additives or chemicals quicker, easier and cleaner than heretofore possible.

Still another object is to provide a container of the foregoing type that are stackable when empty or filled.

An additional object is to provide a container that is reusable and can be resealed and stored when only part of the contents are used and the remainder is to be used at a latter time.

Other objects of the invention will become apparent from the following description when taken with the drawings which accompany and form part of, this specification.

BRIEF DESCRIPTION OF THE DRAWINGS

FIG. 1 is a fragmentary longitudinal section of the spout, locking ring and container neck in place ready for use and emptying of the container contents.

FIG. 2 is a similar fragmentary longitudinal section of the spout, locking ring, container neck and plug for container shipment and storage prior to use.

FIG. 3 is a exploded fragmentary perspective view of the container neck, the spout, the locking ring and the plug.

FIG. 4 is a fragmentary longitudinal section of a second embodiment showing the container with a conical spout threaded at the base to the container neck and at its top to a threaded cap.

FIG. 5 is a fragmentary longitudinal section of another embodiment of spout top with integral but severable closure cap in position for shipping.

FIG. 6 is a similar longitudinal section of the embodiment of FIG. 5 showing the spout cap severed and closing top of the spout.

FIG. 7 is a fragmentary longitudinal section of still another embodiment showing the spout connected to the container neck by spin welding or the like.

FIG. 8A is a fragmentary sectional view showing a bottom recess or push-up of the container of the invention adapted to receive a container neck or the closed neck of FIG. 2 for stackability.

FIG. 8B is a similar fragmentary sectional view of a bottom recess or push-up of the container of the invention adapted to receive container spout of FIG. 1 or FIGS. 4–7 for stackability.

DESCRIPTION OF THE PREFERRED EMBODIMENTS

In the drawings, the complete package peculiarly adapted for containing and depensing oil, automotive additives or chemicals is comprised of container 10, circular disc plug 30, conical spout 40 and locking ring 50.

The container 10 has a cylindrical orifice 15 protruding from the top. On the exterior surface of orifice 15 there is a screw thread 20.

The conical spout 40 has a circular circumferentially extending flange 45 projecting radially outwardly from the base of the conical side walk in a plane normal to the axis of the spout.

The locking ring 50 is cylindrical in shape and has an annular wall 60 and a circular top 61 with a circular central opening. The annular wall 60 has a screw thread 55 on the interior wall which is designed to mate with the screw thread 20 of the neck 15.

The circular disc plug 33 cooperates in sealing the container neck during shipment and storage and is comprised of circular integral discs 30 and 35. The smaller disc 30 is centered on the top of the larger disc 35. As shown in FIG. 2 the smaller disc 30 is adapted to fit the circular cavity formed by the circular top 61 of the locking ring 50. The larger disc 35 is substantially equal in diameter to the circular flange 45.

When set up for pouring, the plug 33 is removed and not in use. The locking ring 50 is placed around the spout 40 as shown in FIG. 1. The diameter of the base of the conical spout 40 is equal to the diameter of the circular hole formed by the top 61 of the locking ring 50. The flange 45 has a diameter equal to the diameter of the interior portion of the annular wall 60. Thus, when locking ring 50 is placed around the spout 40 and placed on the neck 15 of the container 10 the locking ring 50 may then be screwed onto the neck 15, causing threads 55 and 20 to engage to form a tight seal. Now the contents of container 10 are ready to be poured.

When not in use the spout 40 is inverted into container 10 through the neck 15. Plug 33 is then placed on top of spout 40. Next locking ring 50 is placed over of the plug 33, the spout 40 and the neck 15. The smaller disc 30 of the plug 33 conveniently fits into the hole formed by the top 61 of locking ring 50. Now, once again threads 55 and 20 can mate with one another as the locking ring 50 is screwed onto the neck 15 and a tight seal will be provided.

The numerous advantages of the present invention will thus be readily appreciated. Above all, a convenient means of storing, shipping and administering oil is provided. No additional opening devices are required. The parts may be plastic, the product is light weight, easily manufactured, substantially unbreakable and no special expertise or dexterity is required for its use.

An alternative embodiment is illustrated in FIG. 4. Instead of being inverted into the container 10, a spout 70 is attached to the container 10 by means of a bead or thread 75 which mate with thread 20 of the neck 15. Thread 75 is on the interior of a cylindrical annular wall 72 at the base of the conical spout 70. At the top of spout 70 there is another cylindrical annular wall 78 projecting upwardly. This annular wall 78 has a thread 80 on its exterior wall. A cap 85 is attached to the spout 70 by means of an internal bead or thread 87 by mating with complementary surface or thread 80 of the upper annular wall 78 of the spout 70 to thereby form a seal near the spout opening. Alternatively, the cap could be heat sealed or spin welded in place or could be a metal or foil sealing disc or cap crimped in place.

In FIG. 5, a spout 90 which may have a similar threaded base to engage the threaded container neck in the previous embodiment is found with an integral circular sealing disc 93 and an integral outwardly unit. Immediately below the circular disc 93 a weakened zone or a groove 94 is found to facilitate opening the top of the spout 90. Thus, once spout cap 90 is screwed onto neck 15, then the cylinder 95 can be cut just below the circular disc 93 at or above groove 94. Now the contents of container 10 can be poured out of spout cap 90. To reseal the container the upper cutaway portion including, disc 93 and the upper half of cylinder 95, can be inverted back over the spout top to form a cap that is held in place by friction as shown in FIG. 6.

It is also contemplated that the spout 70' need not be screwed on to the container neck but alternatively, it can be spin welded in place, as seen in FIG. 7.

In FIG. 8A the bottom of the container is shown with a recess or push-up for receiving a container neck or sealed neck of FIG. 2 for stackability. FIG. 8B shows another form of recess or push-up for receiving a spout of FIG. 1 or FIGS. 4–7 for stackability.

Thus the several aforenoted objects and advantages are most effectively attained. Although several somewhat preferred embodiments have been disclosed and described in detail herein, it should be understood that this invention is in no sense limited thereby and its scope is to be determined by that of the appended claims.

What is claimed:

1. A plastic container with an upwardly extending integral neck, a conical spout having a base and top, means for connecting the base to the neck, closure means closing the top, said conical spout having a cylindrical annular wall protruding from both the base and the top, said cylindrical annular wall protruding from the base having a bead or thread on its interior wall, said cylindrical annular wall protruding from the top having an integral step in its outer surface equal to the thickness of the wall, said top cylindrical annular wall having an integral circular disc disposed in a plane perpendicular to the axis of the spout located above the step in said cylindrical annular wall.

2. The invention in accordance with claim 1 wherein said top cylindrical annular wall has a groove on the interior, just below said circular disc, so as to weaken said wall, so that the upper half of said top cylindrical annular wall can be cut just below said step and inverted to be used as a cap for said spout.

3. The invention in accordance with claim 1 wherein said base of said container includes a push-up for receiving said neck, closure or spout of another container for stackability.

* * * * *